US012098525B2

(12) United States Patent
Jang et al.

(10) Patent No.: US 12,098,525 B2
(45) Date of Patent: Sep. 24, 2024

(54) CONSTRUCTION MACHINE

(71) Applicant: HD HYUNDAI INFRACORE CO., LTD., Incheon (KR)

(72) Inventors: Jeong Kwon Jang, Goyang-si (KR); Min Ho Gang, Incheon (KR)

(73) Assignee: HD HYUNDAI INFRACORE CO., LTD., Incheon (KR)

( * ) Notice: Subject to any disclaimer, the term of this patent is extended or adjusted under 35 U.S.C. 154(b) by 47 days.

(21) Appl. No.: 17/907,865

(22) PCT Filed: Mar. 12, 2021

(86) PCT No.: PCT/KR2021/003082

§ 371 (c)(1),
(2) Date: Aug. 29, 2022

(87) PCT Pub. No.: WO2021/187810

PCT Pub. Date: Sep. 23, 2021

(65) Prior Publication Data

US 2023/0128144 A1 Apr. 27, 2023

(30) Foreign Application Priority Data

Mar. 19, 2020 (KR) ..... 10-2020-0033942

(51) Int. Cl.
*E02F 9/22* (2006.01)

(52) U.S. Cl.
CPC ..... *E02F 9/2285* (2013.01); *E02F 9/226* (2013.01)

(58) Field of Classification Search
CPC ..... E02F 9/2221; E02F 9/2094; E02F 9/226; E02F 9/2285
See application file for complete search history.

(56) References Cited

U.S. PATENT DOCUMENTS 8,544,263 B2 10/2013 Kim

FOREIGN PATENT DOCUMENTS

| | | | |
|---|---|---|---|
| CN | 1827928 | A | 9/2006 |
| CN | 107110035 | A | 8/2017 |
| CN | 110291253 | A | 9/2019 |
| JP | WO2016166854 | A1 | 10/2017 |
| KR | 101069450 | B1 | 9/2011 |

(Continued)

OTHER PUBLICATIONS

Office Action for related Chinese Application No. 202180019770.9; action dated May 31, 2023; (7 pages).

(Continued)

*Primary Examiner* — Kenneth Bomberg
*Assistant Examiner* — Daniel S Collins
(74) *Attorney, Agent, or Firm* — K&L Gates LLP

(57) ABSTRACT

Disclosed is a construction machine including: an engine generating power; a pump generating hydraulic pressure by receiving power generated from the engine; a main control valve receiving signal oil from the pump; a key switch capable of turning on and off power of an electronic unit; an engine control unit that maintains operation of the engine for a predetermined time and then stops operation of the engine when the key switch is switched from an on-state, during which power of the electronic unit may be turned on, to an off-state; and a pilot cut-off valve for opening and closing the signal oil according to the state of the key switch, and an accident caused by the engine control unit may be prevented by the construction machine.

9 Claims, 7 Drawing Sheets

(56) References Cited

FOREIGN PATENT DOCUMENTS

| | | | |
|---|---|---|---|
| KR | 20170048493 | A | 5/2017 |
| KR | 20180034877 | A | 4/2018 |
| KR | 20190104208 | A | 9/2019 |

OTHER PUBLICATIONS

International Search Report for related International Application No. PCT/KR2021/003082; action dated Sep. 23, 2021; (5 pages).
Written Opinion for related International Application No. PCT/KR2021/003082; action dated Sep. 23, 2021; (5 pages).
Office Action for related Chinese Application No. 202180019770.9; action dated Jan. 19, 2024; (6 pages).
Office Action for related Korean Application No. 10-2022-7028835; action dated Jan. 22, 2024; (12 pages).

CONSTRUCTION MACHINE

CROSS-REFERENCE TO RELATED APPLICATIONS

This application is the National Stage filing under 35 U.S.C. 371 of International Application No. PCT/KR2021/003082, filed on Mar. 12, 2021, which claims the benefit of earlier filing date and right of priority to Korea utility model Application No. 10-2020-0033942 filed on Mar. 19, 2020, the contents of which are all hereby incorporated by reference herein in their entirety.

FIELD

The present disclosure relates to a construction machine, and more particularly, to a construction machine capable of performing civil works and building works.

BACKGROUND

In general, a construction machine includes an engine for generating power, for example, an excavator or a loader as a machine used in civil works or construction work, a hydraulic device for generating and transmitting hydraulic pressure by receiving power generated from the engine, a working unit that performs work with hydraulic pressure received from the engine, and an engine control unit for preventing damage to a post-processing unit by delaying the engine stop while the post-processing unit that post-processes the gas discharged from the engine is at a high temperature, and a pilot cut-off valve that opens and closes the hydraulic device.

FIG. 1 is a diagrammatic representation showing a conventional construction machine and shows a case in which a key switch is in an on-state, FIG. 2 is a diagrammatic representation showing a state in which the key switch is in an off-state and the engine control unit is operated in the construction machine of FIG. 1, and FIG. 3 is a flowchart illustrating an operation process of the engine control unit in the construction machine of FIG. 2.

Referring to FIGS. 1 to 3, the conventional construction machine includes a key switch 41 capable of turning on and off power of an electronic unit, an engine control unit maintaining the operation of the engine 10 for a predetermined time and stopping the operation when the key switch 41 switches from an on-state where power of the electronic unit is turned on to an off-state where the power is turned off, and a pilot cut-off valve for opening and closing a hydraulic device 20.

Here, the conventional construction machine further includes an alternator 50 that generates electricity by receiving power from the engine 10 and a battery 60 that stores the electricity produced in the alternator 50 and discharges it to various locations demanding electricity, and the pilot cut-off valve is connected to a circuit extending from the alternator 50 to the battery 60.

However, in the conventional construction machine, there was a problem that an accident occurs by the engine control unit. Specifically, when the engine control unit is operated, the alternator 50 continues producing electricity as the engine 10 continues being driven. However, as the pilot cut-off valve is connected to a circuit extending from the alternator 50 to the battery 60, the pilot cut-off valve is operated to open the hydraulic device 20. Accordingly, although the key switch 41 is in the off-state, a pedal or a joystick of a passenger seat may be manipulated due to a driver's movement, mistake, and the like, and then a working unit may be operated, thereby a safety accident may occur.

SUMMARY

Accordingly, the present disclosure aims to provide a construction machine capable of preventing an accident caused by an engine control unit.

One embodiment is a construction machine including: an engine 100 generating power; a pump generating hydraulic pressure by receiving power generated from the engine; a main control valve receiving signal oil from the pump; a key switch capable of turning on and off power of an electronic unit; an engine control unit that maintains operation of the engine for a predetermined time and then stops operation of the engine when the key switch is switched from an on-state, during which power of the electronic unit may be turned on, to an off-state; and a pilot cut-off valve for opening and closing the signal oil according to the state of the key switch.

The construction machine further includes: an alternator receiving power from the engine to generate electricity; and a battery storing electricity produced by the alternator and discharging electricity to the key switch, and the pilot cut-off valve may be formed to open and close the signal oil by receiving electricity from the battery through the key switch.

The pilot cut-off valve may be formed to close the signal oil when the key switch is in an off-state.

The construction machine may further include: a pilot cut-off line electrically connecting the pilot cut-off valve and an output terminal of the key switch.

The pilot cut-off line may be branched from a battery relay connection terminal line extending from an output terminal to the engine control unit.

The key switch may include: an input terminal; an output terminal; and a key switch bridge that electrically connects the input terminal and the output terminal in an on-state and breaks the electrical connection between the input terminal and the output terminal in an off-state.

The pilot cut-off valve reciprocates by a solenoid coil that forms a magnetic field when electricity is applied through the pilot cut-off line, and may open and close the hydraulic device. The pilot cut-off valve may further include: a pilot cut-off switch for opening and closing the pilot cut-off line.

The pilot cut-off switch may include: a first port electrically connected to an output terminal of the key switch; a second port electrically connected to the solenoid coil; and a pilot cut-off switch bridge for connecting and disconnecting the first port and the second port.

The construction machine may further include: a charging line electrically connecting the battery and the alternator; and a discharging line electrically connecting the charging line and an input terminal of the key switch to each other.

Another embodiment is a construction machine including: an engine generating power; a pump generating hydraulic pressure by receiving power generated from the engine; a main control valve receiving signal oil from the pump; a key switch that may turn on and off power of an electronic unit; an engine control unit that maintains operation of the engine for a predetermined time and then stops operation of the engine when the key switch is switched from an on-state, during which power of the electronic unit may be turned on, to an off-state; a battery relay connection terminal line extending from the output terminal of the key switch to the engine control unit; a pilot cut-off line branched from the battery relay connection terminal line; and a pilot cut-off valve connected to the pilot cut-off line and opening the signal oil when the key switch is in an on-state and closing the signal oil when the key switch is in an off-state.

Since a construction machine according to the present disclosure includes an engine generating power; a pump generating hydraulic pressure by receiving power generated from the engine; a main control valve receiving signal oil from the pump; a key switch capable of turning on and off power of an electronic unit; an engine control unit that maintains operation of the engine for a predetermined time and then stops operation of the engine when the key switch is switched from an on-state, during which power of the electronic unit may be turned on, to an off-state; and a pilot cut-off valve for opening and closing the signal oil according to the state of the key switch.

DETAILED DESCRIPTION

Hereinafter, a construction machine according to the present disclosure will be described in detail with reference to the accompanying drawings.

Figure 4:
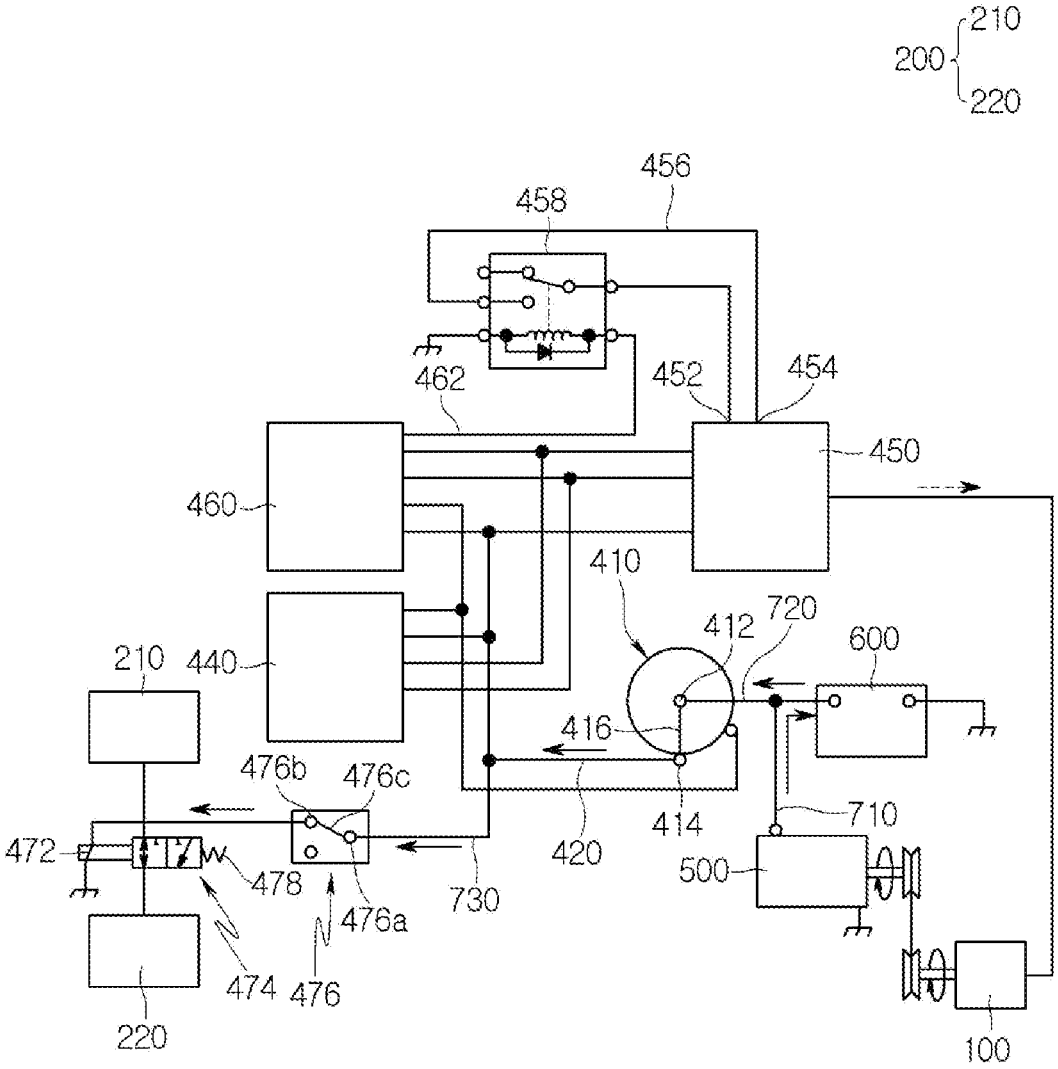
FIG. 4 is a diagrammatic representation showing a construction machine according to an embodiment of the present disclosure, and illustrating a case in which a key switch is in an on-state.
Figure 5:
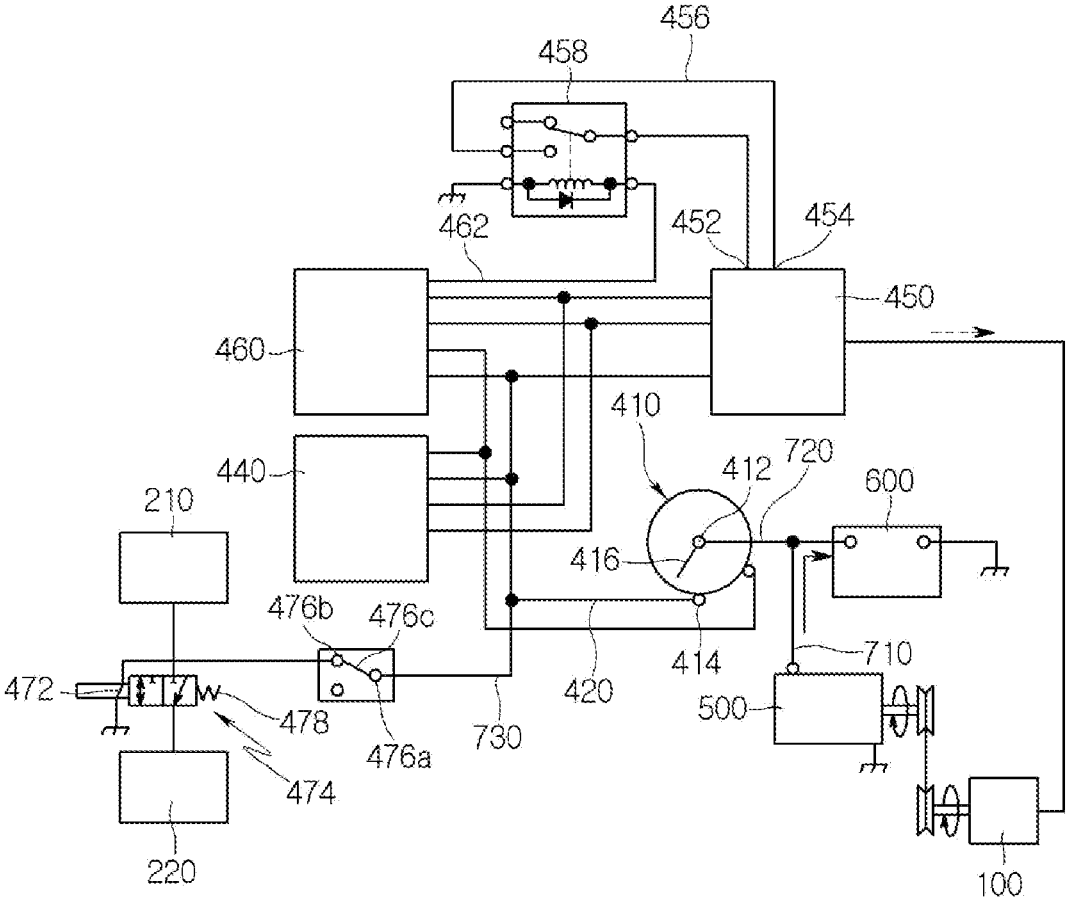
FIG. 5 is a diagrammatic representation showing a state in which a key switch is in an off-state and an engine control unit is operating in the construction machine of FIG. 4.
Figure 6:
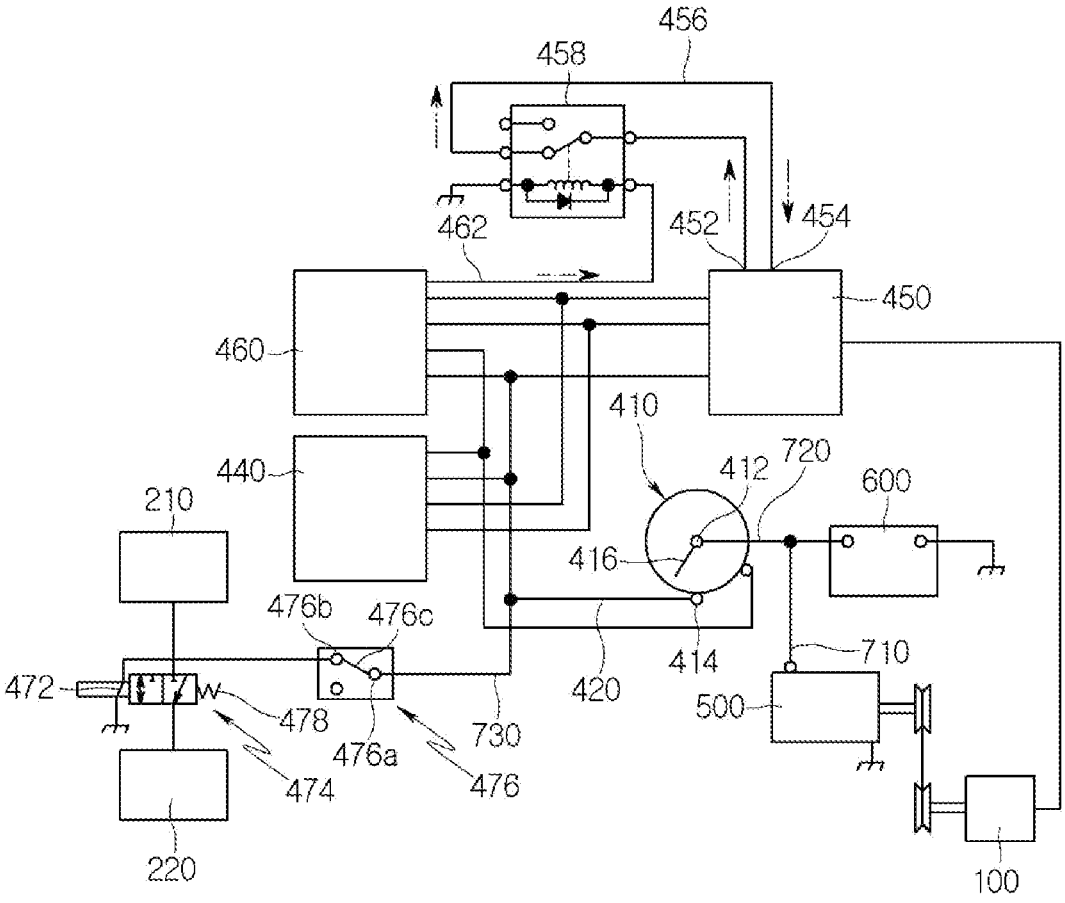
FIG. 6 is a diagrammatic representation showing a state in which a vehicle control unit in FIG. 5 is operated.
Figure 7:
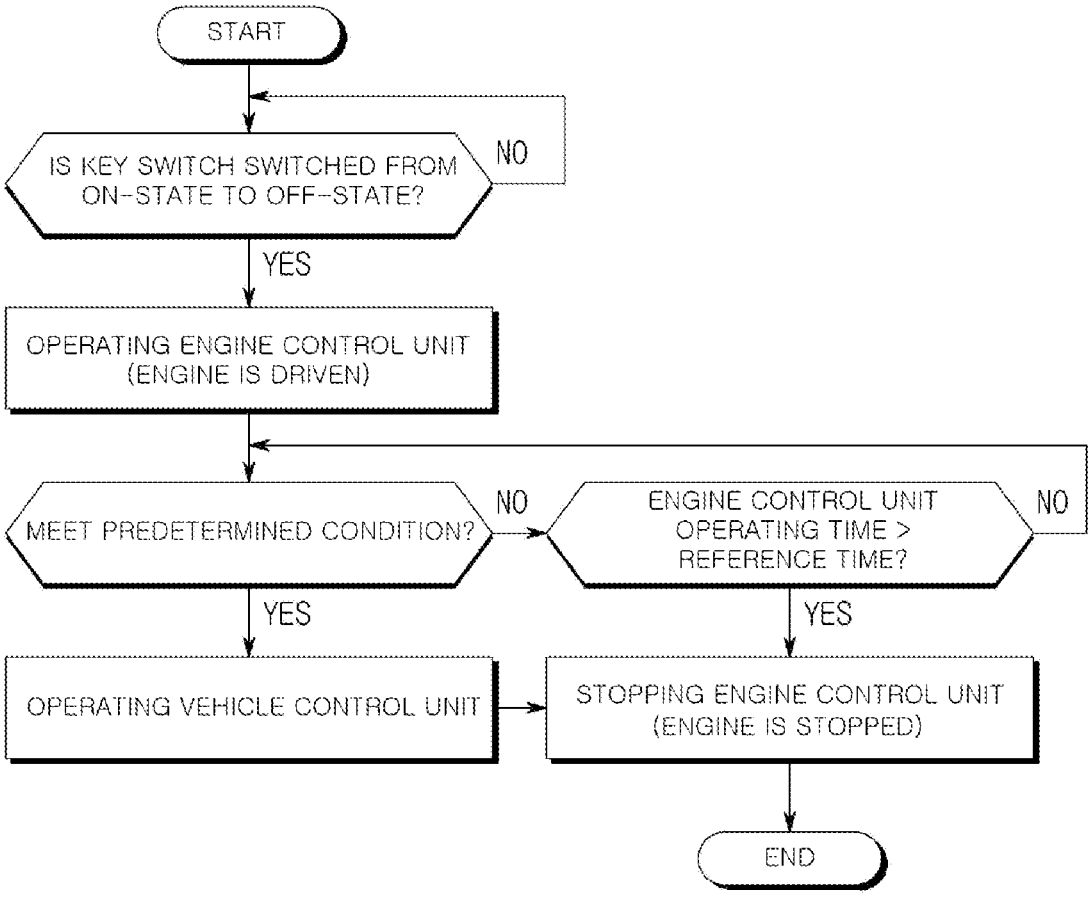
FIG. 7 is a flowchart illustrating an operation process of an engine control unit and a vehicle control unit in FIGS. 5 and 6.

FIG. 4 is a diagrammatic representation showing a construction machine according to an embodiment of the present disclosure, and illustrating a case in which a key switch is in an on-state, FIG. 5 is a diagrammatic representation showing a state in which a key switch is in an off-state and an engine control unit is operating in the construction machine of FIG. 4, FIG. 6 is a diagrammatic representation showing a state in which a vehicle control unit in FIG. 5 is operated, and FIG. 7 is a flowchart illustrating an operation process of an engine control unit and a vehicle control unit in FIGS. 5 and 6.

With reference to FIGS. 4 to 6, the construction machine according to the embodiment of the present disclosure may include a boarding unit that provides a boarding space to a driver, and a driving unit that performs an excavation work that is operated by the driver to dig the ground, a loading work for transporting soil, a crushing work for dismantling a building, a soil preparation work for cleaning the ground, and the like.

The boarding unit may include a passenger seat formed on an upper rotating body to be described later, in which the driver may sit, and a pedal and a joystick disposed around the passenger seat.

In addition, a key switch 410 and a gauge panel 440, which will be described later, may be formed on the boarding unit.

The driving unit may include the engine 100 for generating power, the hydraulic device 200 for generating and transmitting hydraulic pressure by receiving power generated from the engine 100, and a working unit (not illustrated) for performing work with the hydraulic pressure received from the hydraulic device 200.

The engine 100 may be formed of, for example, a diesel engine that compresses and combusts fuel such as diesel and converts it into mechanical energy.

In addition, the engine 100 may include a post-processing device (not illustrated) that removes harmful substances from exhaust gas generated due to combustion of fuel.

The hydraulic device 200 may include a pump 210 that generates hydraulic pressure and a main control valve 220 that transmits signal oil from the pump 210 to the working unit (not illustrated).

The working unit (not illustrated) includes a lower traveling body movable along the ground, an upper rotating body rotatably provided in an upper portion of the lower traveling body, a boom rotatably coupled to the upper rotating body, a boom cylinder for rotating the boom, an arm rotatably coupled to a tip of the boom, an arm cylinder for rotating the arm, a bucket rotatably coupled to a tip of the arm, and a bucket cylinder for rotating the bucket.

On the other hand, in the construction machine according to the present embodiment, a key switch 410 capable of turning on and off the power of the electronic unit, an engine control unit 450 that maintains the operation of the engine 100 for a predetermined time and then stops the operation of the engine 100 when the key switch 410 is switched to an on-state in which the power of the electronic unit may be turned off to an off-state in which the power of the electronic unit may be turned off, and a vehicle control unit 460 that transmits a signal to stop the engine 100 forcedly in a predetermined situation.

Here, the predetermined situation is, for example, a situation in which a driver wants the engine 100 to stop, such as a situation when the driver has to urgently leave a passenger seat due to a fire, and the construction machine may be formed to operate the vehicle control unit 460 when a signal is received from the driver in such a situation.

Specifically, a gauge panel 440 providing information to the driver is provided, and the gauge panel 440 may include a forced engine stop button that receives the signal from the driver.

In addition, the vehicle control unit 460 may be electrically connected to the key switch 410 and the gauge panel 440.

In addition, the vehicle control unit 460 may include a relay control circuit 462 through which a relay control current flows when receiving the signal from the gauge panel 440 (more precisely, the forced engine stop button).

In addition, the engine control unit 450 may include a transmitting terminal 452 for transmitting an emergency trip current, a receiving terminal 454 for receiving the emergency trip current transmitted from the transmitting terminal 452, and an emergency trip circuit 456 electrically connecting the transmitting terminal 452 and the receiving terminal 454, and a relay 458 operated by a relay control current flowing through the relay control circuit 462 and opens and closes the emergency trip circuit 456.

Here, it may be preferable for the forced engine stop button to be formed to be lit when the engine control unit 450 is being operated, to make the driver recognize that the engine control unit 450 is in an operating state and is in a state capable of operating the vehicle control unit 460.

Meanwhile, the construction machine may further include a pilot cut-off valve 474 for opening and closing the signal oil according to the state of the key switch 410.

Specifically, the construction machine may further include an alternator 500 that receives power from the engine 100 and produces electricity, and a battery 600 storing electricity produced in the alternator 500 and discharging the electricity to various locations demanding electricity, and the pilot cut-off valve 474 may be formed to receive the electricity from the battery 600 through the key switch 410 and to open and close the signal oil.

In particular, the pilot cut-off valve 474 may be configured to close the signal oil when the key switch 410 is in an off-state.

More specifically, the driving unit may further include a charging line 710 that electrically connects the battery 600 and the alternator 500, a discharging line 720 that electrically connects the charging line 710 and an input terminal 412 of the key switch 410, and a pilot cut-off line 730 that electrically connects the pilot cut-off valve 474 and an output terminal 414 of the key switch 410.

Here, the key switch 410 includes a key switch bridge 416 that electrically connects the input terminal 412 and the output terminal 414 in an on-state, and breaks the electrical connection between the input terminal 412 and the output terminal 414 in an off-state, and the key switch bridge 416 may be operated by a driver.

In addition, the pilot cut-off line 730 may be branched from a battery relay connection terminal line 420 connecting the output terminal 414 to the gauge panel 440, the engine control unit 450, and the vehicle control unit 460.

In addition, the pilot cut-off valve 474 may be formed to reciprocate by a solenoid coil 472 that is electrically connected to the pilot cut-off line 730 and forms a magnetic field when electricity is applied through the pilot cut-off line 730, and to open and close the signal oil.

Here, a pilot cut-off switch 476 for opening and closing the pilot cut-off line 730 may be further provided, and the pilot cut-off switch 476 includes a first port 476*a* electrically connected to the output terminal 414 of the key switch 410, a second port 476*b* electrically connected to the solenoid coil 472, and a pilot cut-off switch bridge 476*c* for connecting and disconnecting the first port 476*a* and the second port 476*b*, and the pilot cut-off switch bridge 476*c* may be operated by a driver.

Hereinafter, the operation and effect of the construction machine according to the present embodiment will be described.

First, the key switch bridge 416 may be operated by a driver to make the key switch 410 be turned on. That is, as shown in FIG. 4, the input terminal 412 and the output terminal 414 may be electrically connected.

Then, the electricity stored in the battery 600 is supplied, through the discharge line 720, the input terminal 412, the key switch bridge 416, the output terminal 414 and the battery relay connection terminal line 420, to the electronic units such as the gauge panel 440, the vehicle control unit 460, and the engine control unit 450, and thereby the engine 100 may be driven.

In addition, the alternator 500 interworking with the engine 100 is driven and generates electricity, and the generated electricity may be charged in the battery 600 through the charging line 710.

On the other hand, some of the electricity stored in the battery 600 and the electricity produced by the alternator 500 may be applied to the pilot cut-off line 730, through the discharge line 720, the input terminal 412, the key switch bridge 416, the output terminal 414 and the battery relay connection terminal line 420.

In addition, the driver may operate the pilot cut-off switch bridge 476*c* to electrically connect the first port 476*a* and the second port 476*b*. That is, the pilot cut-off switch 476 may get into an on-state.

Then, the electricity applied to the pilot cut-off line 730 passes through the pilot cut-off switch 476 and is applied to the solenoid coil 472, and a magnetic field may be applied to the pilot cut-off valve 474.

Then, the pilot cut-off valve 474 may be moved, and the pump 210 and the main control valve 220 may be connected.

Further, when the pedal and the joystick of the boarding unit are operated by the driver, the lower traveling body is moved to a work site, and the boom cylinder, the arm cylinder, and the boom cylinder are operated and may perform works such as digging or reducing the ground.

Figure 1:
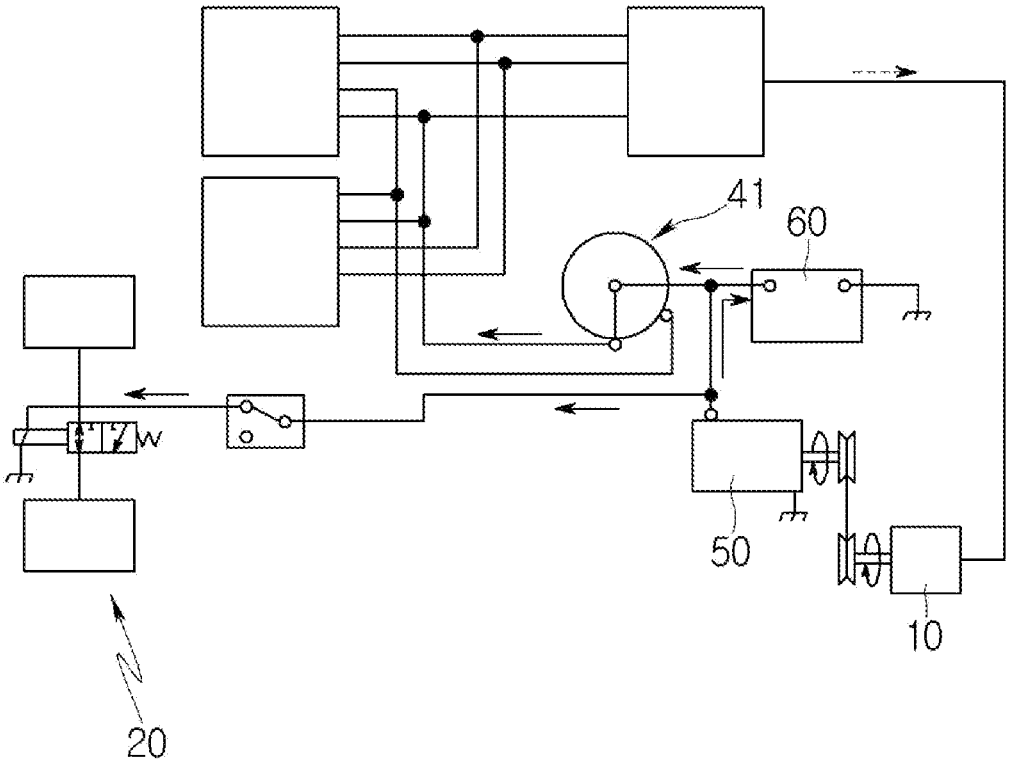
FIG. 1 is a diagrammatic representation showing a conventional construction machine and shows a case in which a key switch is in an on-state.
Figure 2:
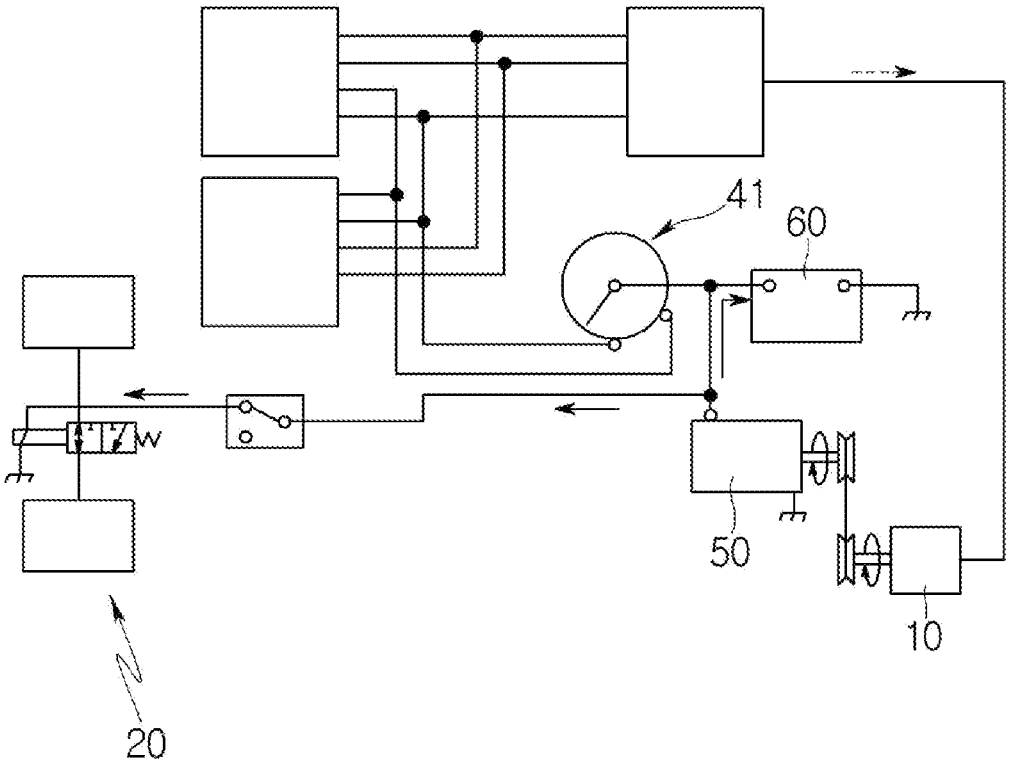
FIG. 2 is a diagrammatic representation showing a state in which a key switch is in an off-state and an engine control unit is operated in the construction machine of FIG. 1.
Figure 3:
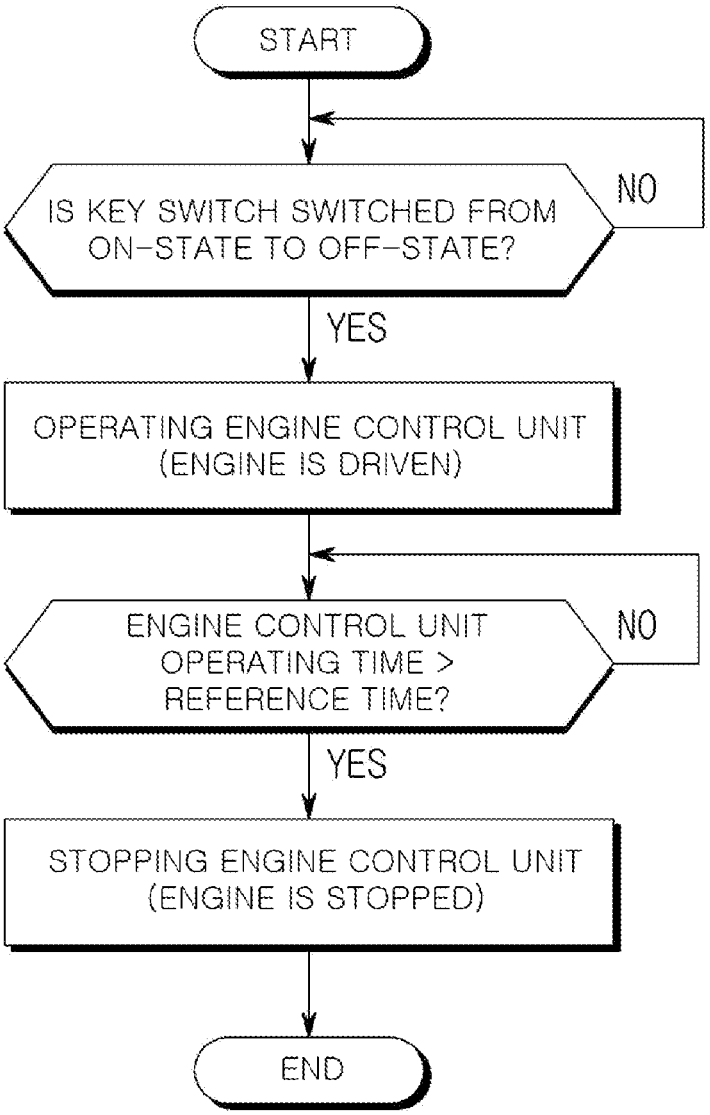
FIG. 3 is a flowchart illustrating an operation process of the engine control unit in the construction machine of FIG. 2.

Here, the solid arrow shown in FIG. 1 shows the flow of electricity produced in the alternator 500 and discharged after being charged in the battery 600, and the dotted arrow shows the flow of an engine control signal transmitted from the engine control unit 450 to the engine 100.

Next, the key switch bridge 416 may be operated by the driver to switch the key switch 410 from an on-state to an off-state. That is, as shown in FIG. 5, an electrical connection between the input terminal 412 and the output terminal 414 may be cut off.

Then, electricity from the battery 600 is no longer applied to the output terminal 414.

However, the engine control unit 450 may be operated, so that the engine 100 may continue being driven. That is, the engine control unit 450 may receive electricity from the battery 600 through a separate line and transmit an engine control signal to the engine 100, and the engine 100 may be continuously driven.

In addition, as shown in FIG. 7, the time after the engine control unit 450 is operated may be counted, and the operating time of the engine control unit 450 may be compared with a predetermined reference time.

Moreover, when the operating time of the engine control unit 450 is equal to or less than the reference time, the operation of the engine control unit 450 is maintained, and when the operating time of the engine control unit 450 exceeds the reference time, the engine 100 may be stopped by stopping the engine control unit 450.

Here, when the engine control unit 450 is operating, the alternator 500 is driven together with the engine 100 to produce electricity, and the generated electricity may be charged in the battery 600 through the charging line 710.

In addition, since the pilot cut-off line 730 is connected to the battery relay connection terminal line 420, the electricity produced by the alternator 500 and the electricity charged in the battery 600 may not be applied to the pilot cut-off line 730. Accordingly, regardless of a state of the pilot cut-off switch 476 (even if the pilot cut-off switch is in an on-state), electricity is not applied to the solenoid coil 472 and a magnetic field is not formed, so that the pilot cut-off valve 474 may be moved by a restoring force by an elastic member 478. Accordingly, the connection between the pump 210 and the main control valve 220 is released, thereby the working unit (not illustrated) may not be operated.

Meanwhile, when the driver presses the forced engine stop button while the engine control unit 450 is operating, the vehicle control unit 460 is operated, and even if the operating time of the engine control unit 450 is less than the reference time, the engine control unit 450 may be stopped, and the engine 100 may be stopped.

Specifically, referring to FIGS. 6 and 7, when the driver inputs a signal by pressing the forced engine stop button, the signal may be transmitted from the gauge panel 440 to the vehicle control unit 460.

Then, the vehicle control unit 460 may apply the relay control signal to the relay control circuit 462.

Then, the relay 458 may be activated, and the emergency trip circuit 456 may be opened.

Then, the emergency trip current transmitted from the transmitting terminal 452 flows to the receiving terminal 454 through the emergency trip circuit 456, and when the receiving terminal 454 receives the emergency trip current, the vehicle control unit 460 may be operated, and the engine 100 may be stopped.

Here, an one-dot chain line arrow shown in FIG. 6 shows the flow of the relay control current, and a two-dot chain line arrow shows the flow of the emergency trip current.

Here, in the construction machine according to the present embodiment, as the engine control unit 450 is provided, it is possible to prevent the engine 100 from being stopped while the post-processing device (not illustrated) is at a high temperature. Accordingly, it is possible to prevent damage to the post-processing device (not illustrated).

In addition, as the vehicle control unit 460 is provided, the driver's inconvenience and accidents caused by the engine control unit 450 may be prevented. That is, even if the engine control unit 450 is in operation, when the engine 100 needs to be stopped immediately (for example, when the driver needs to get off the construction machine urgently, when a fire occurs, and the like), the engine 100 may be stopped immediately according to operation of the driver, and the inconvenience that the driver has to be in the boarding unit until the engine 100 is stopped, vehicle fire, and injury to the driver may be prevented.

In addition, the pilot cut-off valve 474 is formed to open and close the signal oil according to the state of the key switch 410, so that an accident caused by the engine control unit 450 may be prevented in advance. That is, as the pilot cut-off valve 474 is connected to the battery relay connection terminal line 420 without being connected to the charging line 710 and the discharging line 720, when the key switch 410 gets into an off-state, electricity may not be applied to the solenoid coil 472 regardless of the state of the pilot cut-off switch 476. Accordingly, while the engine control unit 450 is operating and the engine 100 is being driven, even if the driver mistakenly turns on the pilot cut-off switch 476 and moves the pedal and the joystick, the working unit (not illustrated) may not operate. Therefore, it is possible to prevent the working unit (not illustrated) from hitting a nearby object or person.

On the other hand, in the present embodiment, the construction machine is formed to receive a signal from the driver through the gauge panel 440 (more precisely, the forced engine stop button) to operate the vehicle control unit 460, but is not limited thereto.

The vehicle control unit 460 may be formed to operate by receiving a signal from the driver through the key switch 410. That is, for example, the vehicle control unit 460 may be formed in a way that the key switch 410 is switched from the off-state to the on-state within a predetermined time and then is switched back to the off-state, so that the signal is input through the key switch 410 and when the signal is transmitted from the key switch 410 to the vehicle control unit 460, a relay control current flows in the relay control circuit 462, the relay 458 is operated, and the emergency trip circuit 456 is opened, the emergency trip current transmitted from the transmitting terminal 452 is received by the receiving terminal 454 to operate the vehicle control unit 460.

Alternatively, the vehicle control unit 460 may be automatically operated according to the vehicle state of the construction machine, regardless of the driver's will. That is, for example, it may be configured to make the vehicle control unit 460 operate, when at least one among an electrical connection between the engine control unit 450 and the vehicle control unit 460, an electrical connection between the gauge panel 440 and the vehicle control unit 460, and an electrical connection between the key switch 410 and the vehicle control unit 460 is cut off.

Meanwhile, in this embodiment, in order to doubly prevent the pilot cut-off valve 474 from malfunctioning, the pilot cut-off line 730 is connected to the output terminal 414 of the key switch 410 and the pilot cut-off switch 476 is provided, but the pilot cut-off switch 476 may be omitted.

The invention claimed is:

1. A construction machine comprising:

an engine generating power;

a pump generating hydraulic pressure by receiving power generated from the engine;

a main control valve receiving signal oil from the pump;

a key switch capable of turning on and off power of an electronic unit;

a battery storing electricity and discharging electricity to the key switch;

an engine control unit that maintains operation of the engine for a predetermined time and then stops operation of the engine when the key switch is switched from an on-state, during which power of the electronic unit capable of being turned on, to an off-state;

a pilot cut-off valve for opening and closing the signal oil according to the state of the key switch;

a pilot cut-off line, branched from a line between an output terminal of the key switch and the engine control unit, wherein the pilot cut-off line electrically connects the pilot cut-off valve and the output terminal of the key switch; and wherein the pilot cut-off valve is formed to open and close the signal oil by receiving electricity from the battery through the key switch.

2. The construction machine of claim 1, further comprising:

an alternator receiving power from the engine to generate electricity; and wherein the battery stores electricity produced by the alternator.

3. The construction machine of claim 2, further comprising:

a charging line electrically connecting the battery and the alternator; and a discharging line electrically connecting the charging line and an input terminal of the key switch to each other.

4. The construction machine of claim 1, wherein the pilot cut-off valve is formed to close the signal oil when the key switch is in an off-state.

5. The construction machine of claim 1, wherein the line between the output terminal of the key switch and the engine control unit is a battery relay connection terminal line extending from the output terminal to the engine control unit.

6. The construction machine of claim 1, wherein the key switch comprises:

an input terminal;

an output terminal; and a key switch bridge that electrically connects the input terminal and the output terminal in an on-state and breaks electrical connection between the input terminal and the output terminal in an off-state.

7. The construction machine of claim 1, wherein the pilot cut-off valve reciprocates by a solenoid coil that forms a magnetic field when electricity is applied through the pilot cut-off line, and opens and closes the hydraulic device.

8. The construction machine of claim 7, further comprising:

a pilot cut-off switch for opening and closing the pilot cut-off line.

9. The construction machine of claim 8, wherein the pilot cut-off switch comprises:

a first port electrically connected to the output terminal of the key switch;

a second port electrically connected to the solenoid coil; and a pilot cut-off switch bridge for connecting and disconnecting the first port and the second port.

* * * * *